US005302082A

United States Patent [19]

Gilbert

[11] Patent Number: 5,302,082

[45] Date of Patent: Apr. 12, 1994

[54] IMPROVED EFFICIENCY GRINDING PUMP FOR SLURRY

[75] Inventor: Robert Gilbert, Paramus, N.J.

[73] Assignee: Arde, Inc., Norwood, N.J.

[21] Appl. No.: 910,243

[22] Filed: Jul. 9, 1992

[51] Int. Cl.[5] ..... F04D 7/04

[52] U.S. Cl. ..... 415/121.1; 415/196; 241/185.6

[58] Field of Search ..... 415/121.1, 115, 196; 241/185.6

[56] References Cited

U.S. PATENT DOCUMENTS

| | | | |
|---|---|---|---|
| 2,029,766 | 2/1936 | Durdin, Jr. . | |
| 2,265,758 | 12/1941 | Klosson . | |
| 2,365,058 | 12/1944 | Crawford | 415/196 |
| 2,371,681 | 3/1945 | Durdin, Jr. | 415/121.1 |
| 2,658,453 | 11/1953 | Walters | 415/121.1 |
| 2,975,714 | 3/1961 | Nechine . | |
| 3,005,597 | 10/1961 | Neidl | 415/121.1 |
| 3,375,983 | 4/1968 | Von Eiff et al. | 415/121.1 |
| 3,402,897 | 9/1968 | Willems | 415/121.1 |
| 3,722,804 | 5/1973 | Petersen | 415/121.1 |
| 3,973,866 | 8/1976 | Vaughan | 415/121.1 |
| 4,141,510 | 2/1979 | Smith . | |
| 4,186,888 | 2/1980 | Galanty . | |
| 4,491,278 | 1/1985 | Galanty . | |
| 4,720,050 | 1/1988 | Eberhardt | 241/46.06 |
| 4,725,007 | 2/1988 | Chupka . | |
| 4,778,336 | 10/1988 | Husain . | |
| 4,826,398 | 5/1989 | Gullichsen | 415/121.1 |

FOREIGN PATENT DOCUMENTS

| | | | |
|---|---|---|---|
| 1153114 | 4/1985 | U.S.S.R. | 415/121.1 |

*Primary Examiner*—Edward K. Look
*Assistant Examiner*—Michael S. Lee
*Attorney, Agent, or Firm*—Cohen, Pontani, Lieberman, Pavane

[57] ABSTRACT

A grinding pump for pumping liquid containing solid and semi-solid matter having an improved efficiency and which requires a lower operating rpm while exhibiting an increased flow rate. The pump includes: a housing having a chamber; a shaft rotatably disposed within the housing, a comminutor on the shaft within the housing and having a helical blade, and an impeller having a vane; and a shredding liner secured to the housing structure in the chamber, so as to cooperate with the comminutor and impeller vane in shredding and pulverizing the matter.

29 Claims, 6 Drawing Sheets

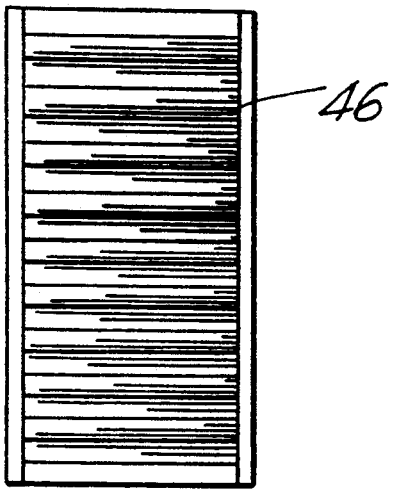
FIG.5
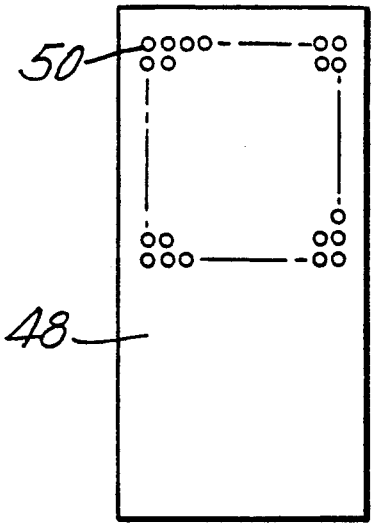
FIG.6
FIG.7
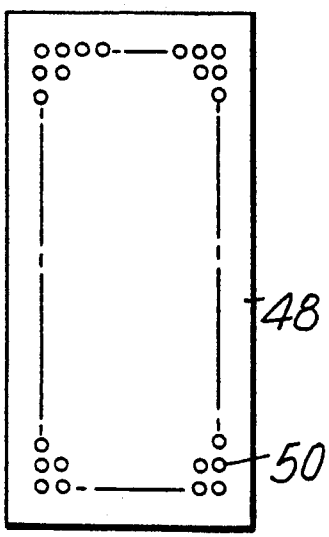
FIG.9
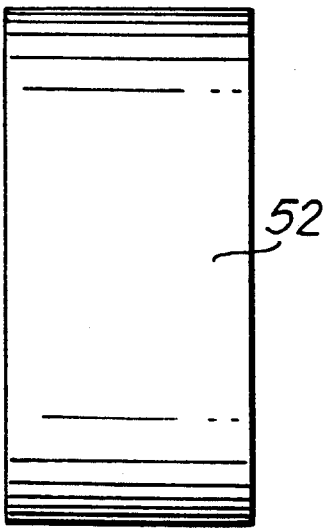
FIG.8
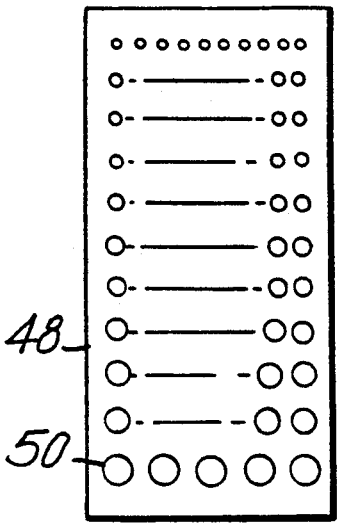

IMPROVED EFFICIENCY GRINDING PUMP FOR SLURRY

FIELD OF THE INVENTION

The present invention relates to a grinding pump, for pumping liquid containing solid and semi-solid matter, whereby the blades and impeller vanes of the pump rotor cooperate with stationary serrated liners within the housing structure so as to tear, shred, grind, pulverize and urge solid matter and the entrained liquid downstream.

BACKGROUND AND SUMMARY OF THE INVENTION

Grinding while pumping a mixture containing liquid and entrained solid and semi-solid matter is a concept which has been known and practiced. However, current grinding pumps only grind and pulverize matter at the upstream end of the grinding pump, in a region between the surface of a rotating comminutor and the interior surface of the grinding chamber. After the mixture has been shredded and pulverized, it is moved along to a pumping section where an impeller forces the liquid and the entrained matter out towards an outlet port. Despite the apparent success of these pumps in the industry, they are not very efficient. Notwithstanding the current methods and devices used in the industry, it is perceived that the efficiency of these pumps has not reached its full potential. Therefore the need exists for still further improvement in the efficiency of grinding pumps, by for example increasing the rate of flow of the liquid and the entrained matter as well as by decreasing the energy requirements as would be readily apparent from a reduction in the required operating rpms.

The object of the present invention is to provide an improved grinding pump capable of pumping liquids containing entrained solid and semi-solid matter, such as raw sewage and the like, while reducing energy requirements and increasing efficiency. The discovery underlying the present invention is the realization that by incorporating the use of serrated edges on the outer edges of the centrifugal pump impeller vanes in cooperation with a serrated interior surface, liquid containing entrained solid and semi-solid matter can also be shredded and pumped by the impeller vanes with less energy and higher efficiency. The discovery is contrary to commercially known prior art teachings that require substantially more energy, exhibit a low efficiency, and limit grinding to the comminutor. The present invention is therefore a substantial improvement as apparent in its efficiency rating of approximately 20%. For the purpose of this application, efficiency is defined as:

$$\text{Efficiency} = \frac{\text{Flow(GPM)} \times \text{Head(FT)}}{3960 \times \text{Horsepower}}$$

Moreover, in order to achieve an efficiency of 20%, the present invention optimally operates in the range of 900–1200 rpms. Such an operating range is unlike other known commercially available grinding pumps which operate at a higher rpm and achieve a lower efficiency.

Accordingly, the present invention relates to a grinding pump for pumping liquids with entrained solid and semi-solid matter comprising: a housing structure having a chamber with a longitudinal axis, said chamber having an inlet port, an intermediate portion defined by an irregular wall surface of revolution, an eccentric portion having an irregular wall surface and an outlet port; a rotatable shaft disposed along said longitudinal axis within said chamber; a comminutor mounted on said shaft within the intermediate portion of said chamber for rotation with said shaft, said comminutor comprising, a helical blade mounted on said shaft and rotatable therewith, the outer edge of said blade being irregular and when rotating defining a complementary surface of revolution to said surface of revolution of said intermediate portion of said chamber wall and closely spaced therefrom, said blade and said surface of revolution defining means for cutting, grinding and urging said matter downstream; a centrifugal pump impeller including at least one vane, said impeller being mounted on said shaft and rotatable therewith, the impeller being located immediately downstream from said blade, and said vane having an irregular edge which when rotating defines a surface of revolution complementary to a portion of said eccentric portion of said chamber and being closely spaced therefrom, said vane and said portion of said eccentric portion of said chamber together defining a second means for cutting and grinding said matter. As used herein, the word "irregular" is not intended to be limited to randomly variable. It is the intention of the applicant that the expression "irregular edge" means an edge having a plurality of projections, that is non-linear and varies from the linear either in a regular periodic or random fashion. Included within the term irregular edge are projections such as saw toothed edges, square toothed edges and serrated edges whether the periodicity of the variations in such edges is constant or varying.

Preferably the irregular chamber wall is provided by an overlay or liner secured to said housing structure along the wall of said chamber, and said liner including one or more shredding liner segments having a surface which is complementary in shape to the surfaces of revolution defined by said comminutor and impeller when rotating. Means are provided for removably securing said liner within said chamber so as to preclude said liner from rotating within said chamber in response to rotation of said shaft; and means for rotating said shaft within said chamber, such as, for example, a motor are also provided.

BRIEF DESCRIPTION OF THE DRAWINGS

The preferred embodiment of the invention will be explained in further detail and in reference to the drawings, in which:

FIG. 5 is a plan view of one type of liner segment especially adapted for shredding;

FIG. 6 is a plan view of another type of liner segment perforated to permit ground slurry to pass therethrough;

FIG. 7 is a plan view of the type of liner segment shown in FIG. 6, wherein the perforations are uniform and extend substantially throughout the length of the liner segment;

FIG. 8 is a view like FIG. 7, wherein the perforations are of varying size; and

FIG. 9 is a plan view of yet another liner segment, without perforations or serrations;

DESCRIPTION OF THE PREFERRED EMBODIMENT

Figure 1:
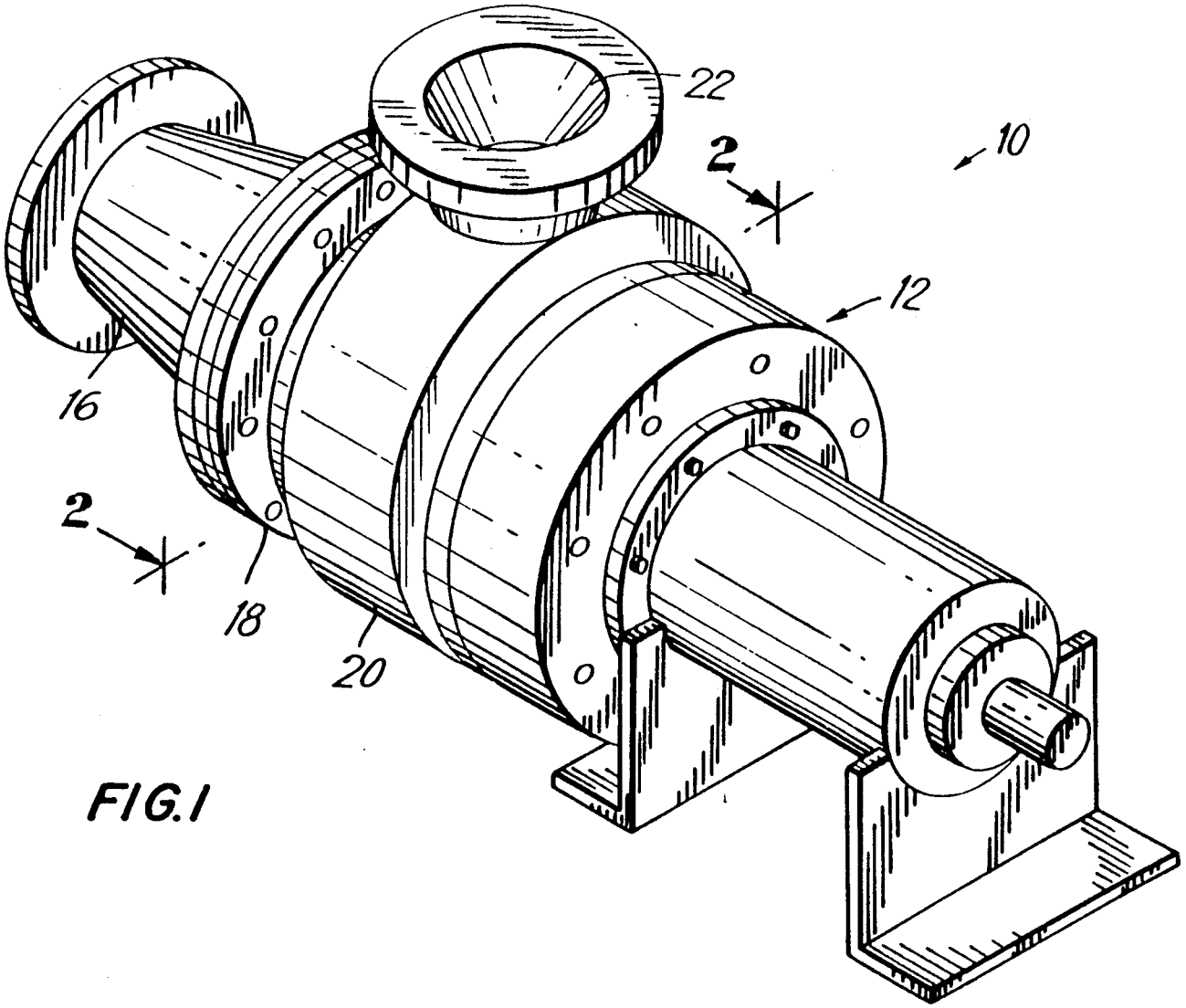
FIG. 1 is a perspective view of a grinding pump embodying the present invention.
Figure 2:
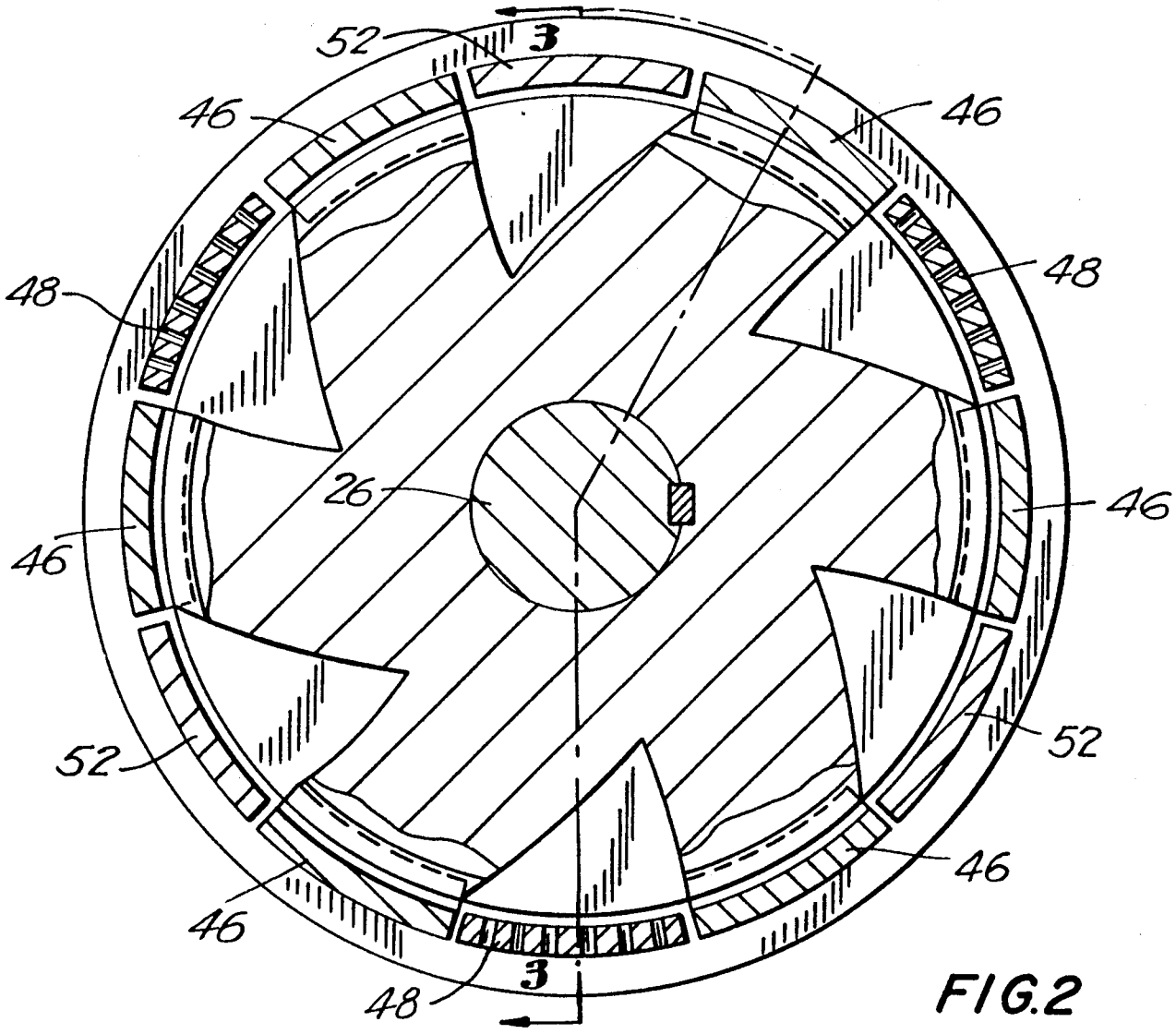
FIG. 2 is a sectional view taken along the line 2—2 in FIG. 1.
Figure 3:
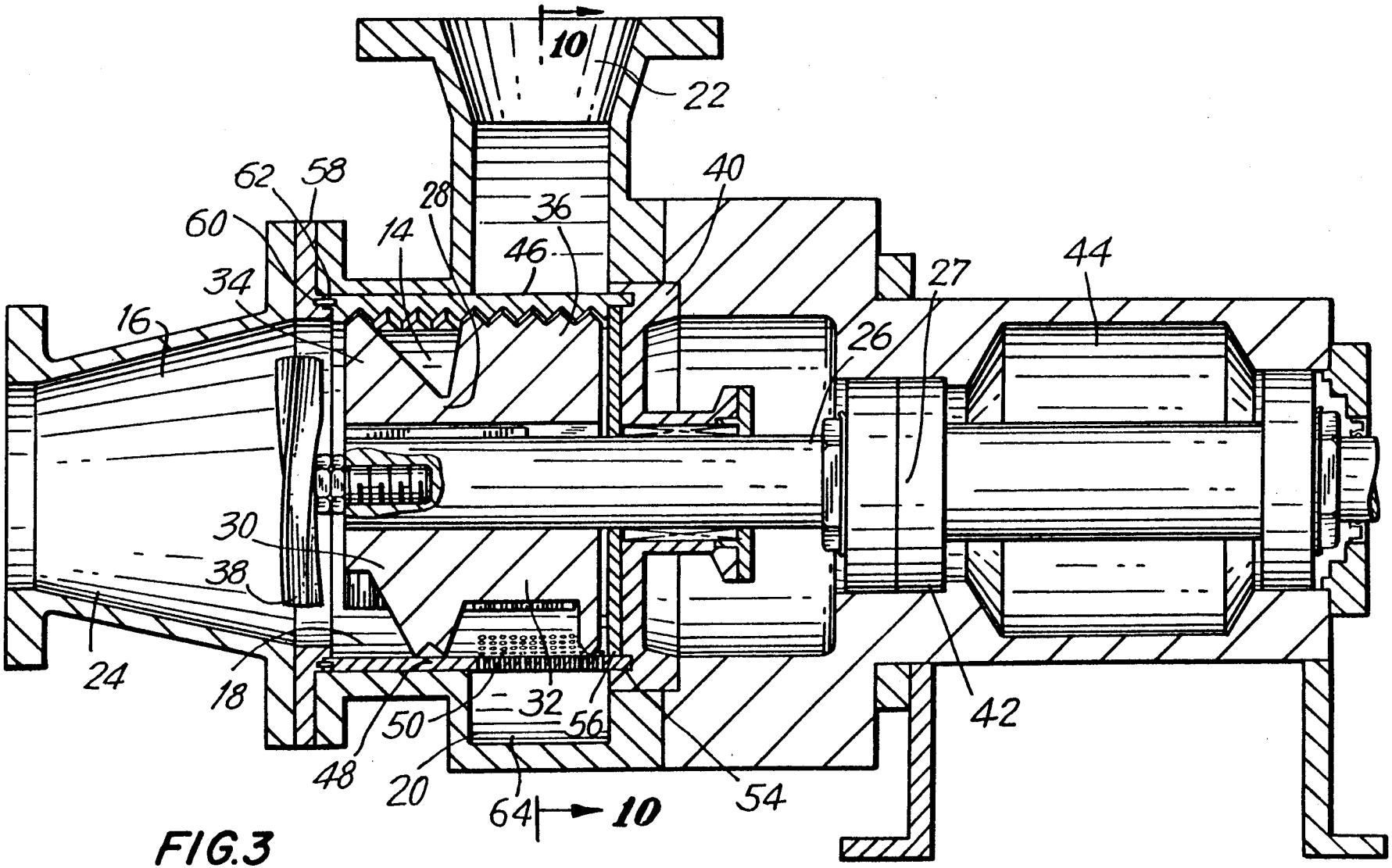
FIG. 3 is a longitudinal sectional view of the grinding pump taken along the line 3—3 in FIG. 2.
Figure 4:
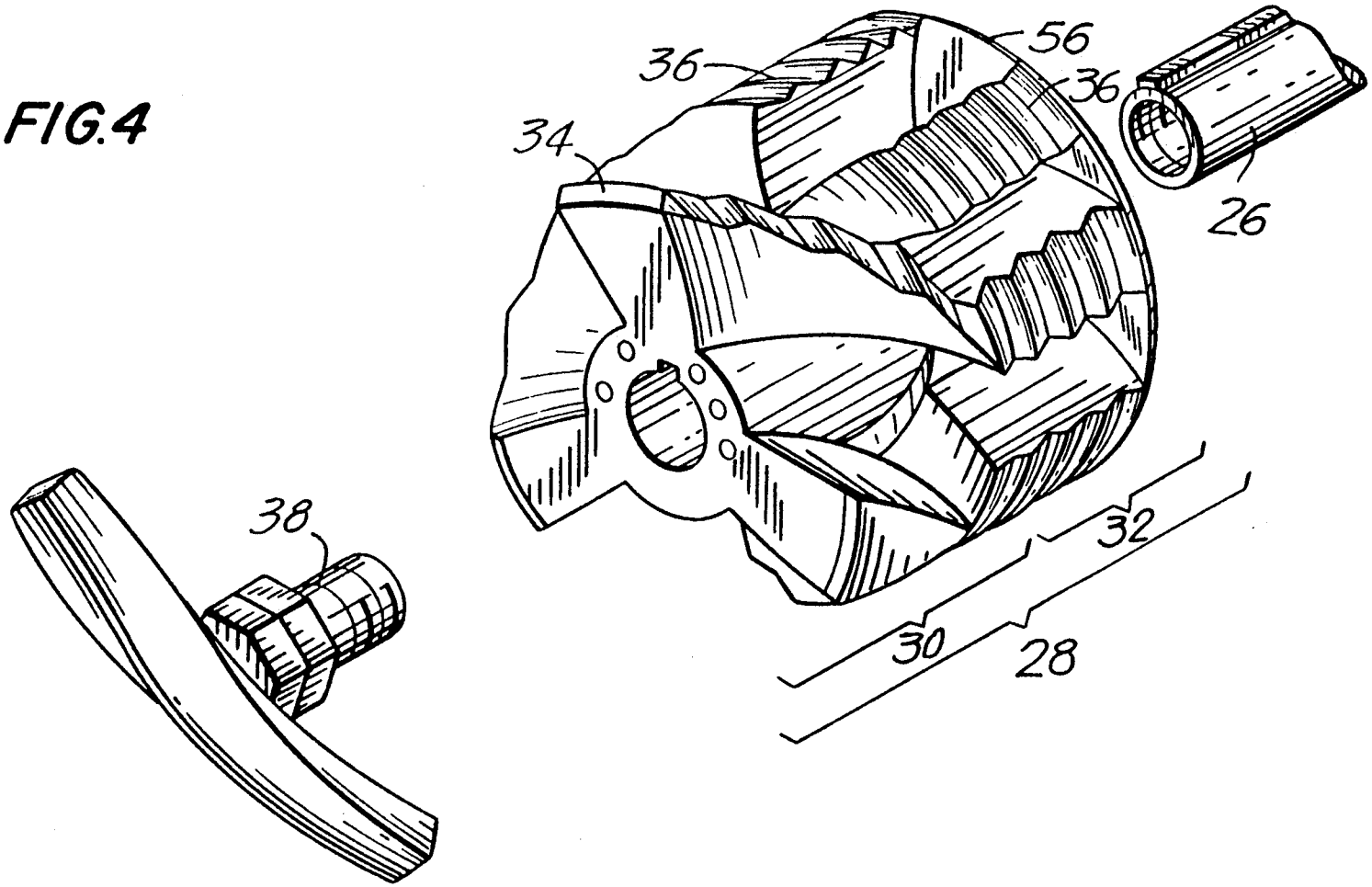
FIG. 4 shows an exploded perspective view of a pre-chop blade, a comminutor and an impeller forming parts of the invention.

A grinding pump assembly which is the subject of this invention, is shown in FIGS. 1 and 3 and is generally designated by the reference numeral 10. The grinding pump assembly 10 includes a housing structure 12 having a chamber 14 with an inlet port 16, an intermediate portion 18, an eccentric portion 20 and an outlet port 22. Liquid containing solid and semi-solid matter, such as raw sewage, which includes grindable matter entrained in water, hereinafter referred to as a slurry, is introduced at the inlet port 16 which preferably is frusto-conical with the diameter at the inlet opening 24 relatively smaller than that found at the downstream end of said inlet port 16. An increase in the inlet port 16 diameter in the downstream direction is preferred in order to pre-rotate the slurry as well as to prevent the backwashing thereof.

A shaft 26 is disposed along the longitudinal axis of chamber 14 and is supported for rotation within the chamber 14 by a bearing 27. Mounted on said shaft 26 for rotation therewith is a rotor 28 including a comminutor 30 and a centrifugal impeller 32, which are preferably integrally formed. The comminutor 30 is made of one or more helical blades 34, preferably three in number, and the impeller includes one or more vanes 36, preferably six in number. While a prototype having three blades and three vanes has been made, it is expected that the use of three blades and six vanes may increase the efficiency of the device of the present invention. The number of helical blades 34 is preferably an integral multiple of the number of vanes 36 or, alternatively, the number of vanes 36 is preferably an integral multiple of the number of helical blades 34 (i.e., 3 blades to 3, 6 or 9 vanes, or 3 vanes to 3, 6 or 9 blades). In addition, the downstream end of each of the blades 34 preferably makes a smooth (i.e. unimpeded or continuous) transition to the upstream edge of one of said vanes 36. Such a design enhances the efficiency of the grinding pump. Preferably, when there are more than one blade or one vane, the blades and/or vanes are uniformly distributed around the comminutor 30 and impeller 32, respectively.

Preferably, although not necessarily, a pre-chop blade 38 is mounted on the end of the shaft 26 in the downstream end of the conical inlet 16 to pre-shred the solid and semi-solid matter before it is passed further downstream to the comminutor 30 and impeller 32. The pre-chop blade 38 is made preferably of stainless steel or any other rust resistant material, and shaped in a variety of known cutting patterns. Shaft 26 extends and is disposed longitudinally throughout the entire chamber from the downstream end of inlet 16 to beyond a rear wall plate 40 which defines the downstream end of chamber 14. The portion of the shaft 26 which extends through the rear wall plate 40 of the housing 12 preferably is connected to a coupling 42 which is in turn driven by a rotating drive means such as an electric motor 44.

In accordance with the invention, the comminutor blades 34 are provided with irregular edge projections, for cutting, shredding, tearing, grinding and pulverizing. The chamber wall defining the intermediate portion 18 and the eccentric portion 20 is shaped complementarily to and closely spaced from the surface of revolution defined by the comminutor blades 34 and the impeller vanes 36 as they rotate with shaft 26. That is, the chamber wall surface is irregular. This establishes a highly effective grinding, shredding and cutting zone for reducing the particular size of the solid and semi-solid matter in the slurry as it is moved through the chamber in a manner to be described hereunder. In effecting this structure, it is preferred that the interior surface of the housing structure 12 is lined with liner segments, some perforated, some irregular or serrated, and some possibly smooth, or some combination of these options. One or more shredding liner segments 46 have an irregular surface for mating with the similarly shaped edges of the blades 34 and vanes 36. Operationally, however, the shredding liner segments 46 and the cutting edges of the comminutor blades 34 and impeller vanes 36 must be spaced apart to form a gap so as to permit the vanes 36 and the blades 34 to rotate and allow the slurry to flow downstream. Although different gap sizes may be used, it is to be recognized that such variations will affect the pressure head vs. flow performance characteristics and the efficiency of the pump 10. Preferably, the spacing between the comminutor blade surface 34 and the shredding liner segments 46 should be approximately 0.79 mm (1/32").

In order to further enhance the flow and thereby the efficiency of the pump, it is preferred that the chamber wall liner also include one or more discharge liner segments 48 and said discharge liner segments 48 have a plurality of apertures 50 so as to function as a screening-/filtering plate. The apertures 50 on the discharge liner segments 48 may be disposed throughout the surface of the liner segment 48, although it is preferred that the apertures 50 be located primarily at substantially the downstream end of the chamber at the eccentric portion 20 of the housing chamber 14. In the preferred embodiment, the diameter of the apertures 50 is uniform and the apertures 50 are preferably positioned over the eccentric portion 20 of the chamber, although the apertures 50 can be provided throughout the entire surface of the discharge liner segment 48. (See FIGS. 6, 7 and 8.) In addition, the aperture sizes can vary and the apertures 50 may extend throughout the surface of the liner segment (see FIGS. 7 and 8). Although not shown in FIG. 3, discharge liner segments 48 having apertures throughout their entire surface require that there exist a space between the liners and the interior surface of the intermediate portion 18 so as to accommodate the outflow of the mixture at the upstream end.

While the shredding liner segments 46 have a serrated or toothed surface, the discharge liner segments 48 are presently contemplated as having smooth surfaces confronting rotor 28, even if only the portion confronting the impeller 32 is perforated. Of course, if desired, the discharge liners 48 could be both serrated and perforated throughout, or partly serrated and partly perforated or partly just serrated and the remainder serrated and perforated. In addition, the present invention can employ the use of plain liner segments 52 having a relatively smooth surface confronting the rotor 28 and which is therefore comparable in shape to the discharge liner segments 48 but without the perforations. The plain liner segments 52 provide a stabilizing zone for the entrained matter as it is ground by the action of the comminutor blades 34 and the impeller vanes 36 in cooperation with shredding liner segments 46.

As presently contemplated, the chamber wall lining is formed of shredding liner segments 46, discharge liner segments 48 and plain liner segments 52 together. For example, they may be alternated around the chamber wall or some other pattern of them may be employed. However, in the presently preferred embodiment, there are twelve liner segments disposed to define the liner for the interior chamber wall, each of the liner segments 46, 48 and 52 occupying approximately 30 degrees of the 360 degree circumference, and arranged in a sequence of discharge segment, shredding segment, plain segment and shredding segment, repeated three times. For example if the first discharge liner segment 48 is located at the six o'clock position and the above referenced pattern is followed in a clockwise direction, the second shredding liner segment of the first group is disposed at the nine o'clock position. A second group follows the first group so that the discharge segment of the second group is located at the 10 o'clock position. The discharge segment starting the third group would start at 2 o'clock. Of course, the entire pattern can be angularly shifted relative to the housing without effecting the presently preferred embodiment of the invention.

In order to hold the shredding, discharge, and plain liner segments 46, 48 and 52 in place within the interior of the housing structure 12, it is preferred that a circumferential groove 54 be provided on the rear wall plate 40 behind a back plate 56, which groove is capable of mating with the ends of said liner segments 46, 48 and 52 such that said liner segments can be positioned parallel to and aligned with the longitudinal axis of the shaft. At the inlet end 16 of the housing structure 12, a retaining liner ring 58 is placed between the inlet port 16 and the intermediate portion 18 of the housing structure 12. On the downstream surface of the retaining liner ring 58, there is a pin 60 projecting downstream and parallel to the longitudinal axis of the shaft 26 which mates with a hole 62 in the adjacent end of either a discharge liner segment 48, shredding liner segment 46 or a plain liner segment 52 while at the other end, said liners engage in a form-lock manner with the circumferential groove 54 of the rear wall plate 40. While the above structure will secure the liners 46, 48 and 52 in place as well as preclude rotation of the liners 46, 48 and 52 within the housing structure 12 and is preferred, other structures for removably locking the liner segments in place may be employed without departing from this invention.

In addition, it is preferable that said liners 46, 48 and 52 be segmented and have a hole mateable with said pin at either end so that said liners can be made reversible and replaceable. Experience has taught that the serrations on said liners positioned upstream experience a greater degree of abrasion than those found downstream. Therefore, in order to optimize the grinding efficiency when the upstream portion becomes worn, the shredding liners 46 may be reversed to place the comparatively unworn ends upstream and thus improve the effectiveness of the grinding pump. Moreover, to further enhance the abrasion resistance of the shredding liners 46 as well as the serrations found on the helical blades 34 and the vanes 36, a coating of boron chrome may be placed on the cutting edges.

In operation, after the slurry enters the inlet port 16 of the housing structure 12 under the urging of the helical comminutor 30 and the centrifugal pump including impeller 32, and has been preshredded by the prechop blade 38, the slurry is urged downstream towards the comminutor 30 and the centrifugal impeller 32 where additional grinding and shredding will take place. The irregular edges of the helical blades 34 in cooperation with the shredding liners 46 grind and shred the slurry, while imparting a spiralling effect on the slurry, forcing it downstream and towards the periphery of the intermediate portion 18 of the housing structure 12. After passing by the helical blades 34, the slurry encounters the irregular edges of the impeller vanes 36 which also grind and shred the slurry as well as urge the slurry against the surface of the liner segments so as to pass through the apertures of the discharge liners and into the eccentric portion 20. Once having entered the eccentric portion 20, the slurry will travel towards the outlet port 22.

Figure 10:
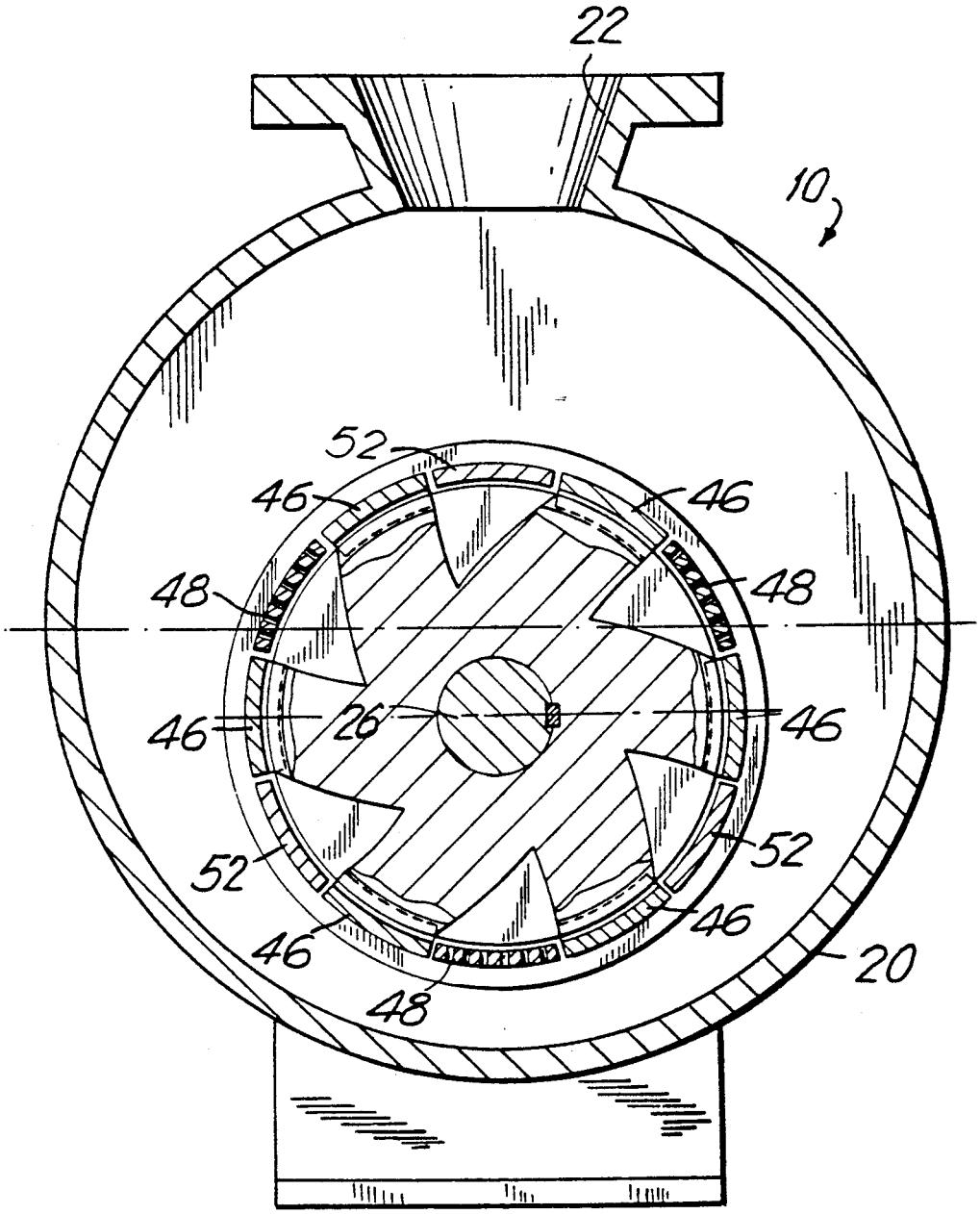
FIG. 10 is a sectional view taken along the lines 10—10 in FIG. 3

The inner surface of the eccentric portion 20 and the outer surface of the 12 liners create a passageway 64 which is cross-sectionally narrower at the bottom (six o'clock position) than it is at the two o'clock and ten o'clock positions (see FIG. 10). The change in cross-sectional areas serves to minimize the pressure difference between the bottom of the eccentric portion 20 and the region in proximity to the outlet port 22. As the slurry is forced out, for example, in the embodiment wherein the discharge liners are located at the six, ten and two o'clock positions, it exits the discharge liner segment at the six o'clock position with a velocity which diminishes as the mixture travels towards the outlet port 22. By arranging additional discharge liners at the ten and two o'clock positions, the slurry forced out through the above discharge liners, minimize the pressure loss between the top and bottom portions of the eccentric chamber.

In its preferred embodiment, the present invention operates in the range of 900–1200 rpms, although the present invention is fully capable of operating at speeds greater than 2000 rpms if desired. A higher operating speed, however, is unnecessary in light of the present invention's 20% efficiency.

While the invention has been described in terms of pumping sewage, it will be recognized that this device may also be employed to advantage in other applications where slurries are to be pumped, such as, for example, waste water from a pulp or paper mill which usually has fiber entrained therein.

It should be understood that the preferred embodiments and examples described are for illustrative purposes only and are not to be construed as limiting the scope of the present invention which is properly delineated only in the appended claims.

What is claimed is:

1. A grinding pump for pumping liquid slurry containing solid and/or semi-solid matter, comprising:

a) a housing structure having a chamber with a longitudinal axis, said chamber having an inlet port, an intermediate portion defined by a wall surface of revolution, said intermediate portion wall surface having a plurality of projections into the chamber intermediate portion, an eccentric portion having a wall surface defining the eccentricity of said eccentric portion, said eccentric portion wall surface having a plurality of projections into the chamber eccentric portion, and an outlet port;

b) a rotatable shaft disposed along said longitudinal axis within said chamber;

c) a rotor mounted on said shaft within said chamber for rotation with said shaft and comprising a comminutor and an impeller, said comminutor and said impeller being disposed serially along said shaft, said comminutor including a helical blade having an outer edge, the outer edge of said helical blade having a plurality of projections and when rotating defining a surface of revolution complementary to and closely spaced from said surface of revolution of the intermediate portion of said chamber, said rotating helical blade operatively urging the slurry downstream; said impeller including a vane with an outer edge and being downstream from said comminutor, the outer edge of said impeller vane having a plurality of projections and when rotating defining a surface of revolution complementary to and closely spaced from a portion of said eccentric portion of said wall surface of said chamber, said vane urging the slurry towards said outlet port during the rotation of said impeller;

d) the plurality of projections on the intermediate and eccentric wall surface portions of said chamber and the complementary shaped rotating blade and impeller vane together comprising means for efficiently cutting, chopping and grinding the solid and semi-solid material of the slurry.

2. The grinding pump as defined in claim 1, wherein the wall of said chamber comprises a liner removably operatively secured to said housing structure.

3. A grinding pump, according to claim 2, wherein said liner includes a discharge liner segment, having one or more holes for permitting ground up slurry to pass therethrough.

4. A grinding pump, according to claim 3, wherein said discharge liner segment includes more than one hole and said holes are of uniform shape and size.

5. A grinding pump, according to claim 3, wherein said discharge liner segment includes more than one hole and at least some of said holes are of different size.

6. A grinding pump, according to claim 3, wherein said liner further comprises a shredding liner segment having a plurality of projections defining a surface complementary to the surface of revolution defined by the rotation of said rotor.

7. A grinding pump, according to claim 6, wherein said liner further comprises a plain liner segment having a relatively smooth surface confronting said rotor.

8. A grinding pump according to claim 7, further comprising a means for securing said liner segments within said chamber for preventing said liner segments from rotating within said chamber.

9. A grinding pump according to claim 8, wherein said means for securing said liner comprises:

a) a rear wall defining the downstream end of said chamber and having a circumferential groove for receiving the downstream end of said discharge liner segment, said shredding liner segment and said plain liner segment;

b) a non-rotatable liner retaining ring disposed between said inlet and said intermediate chamber portion;

c) a pin secured to said retaining ring and extending into said intermediate portion of said chamber; and d) at least one of said liner segments having a hole in the end thereof for receiving said pin, whereby to prevent said liner from rotating.

10. A grinding pump according to claim 9, wherein said shredding, plain and discharge liner segments each has a hole at both ends so as to permit said liners to be reversible and equally engagable with said pin at either end.

11. A grinding pump according to claim 1, wherein there are more that one helical blades included in said comminutor.

12. A grinding pump according to claim 11, wherein the number of blades is an integral multiple of the number of said impeller vanes.

13. A grinding pump, according to claim 1, wherein there are more than one impeller vane in said impeller.

14. A grinding pump according to claim 13, wherein the number of impeller vanes is an integral multiple of the number of helical blades in said comminutor.

15. A grinding pump according to claim 1, wherein the outer edges of said vane and blade are serrated or tooth shaped.

16. A grinding pump according to claim 15, wherein the liner includes a shredding liner segment and the plurality of projections on the surface of said shredding liner segment is serrated or tooth shaped complementary to said blade and vane edges.

17. A grinding pump according to claim 1, further comprising a pre-chop blade mounted on said shaft for rotation therewith, and disposed upstream from said rotor, for pre-shredding said matter before said matter engages with said rotor comminutor.

18. A grinding pump according to claim 1, wherein the inlet port of said housing structure has a frusto-conical opening for pre-rotating and preventing the backwash of said slurry.

19. A grinding pump according to claim 1, wherein the downstream end of said blade smoothly joins to said impeller vane.

20. A grinding pump for pumping liquid slurry containing solid and/or semi-solid matter, comprising:

a) a housing structure having a chamber with a longitudinal axis, said chamber having an inlet port, an intermediate portion defined by a wall surface of revolution, said intermediate portion wall surface having a plurality of projections, an eccentric portion having a wall surface, said wall surface of said eccentric portion carrying a plurality of projections, and an outlet port;

b) a rotatable shaft disposed along said longitudinal axis within said chamber;

c) a rotor mounted on said shaft within said chamber for rotation with said shaft and comprising a comminutor and an impeller, said comminutor including a helical blade having an outer edge, the outer edge of said helical blade having a plurality of projections and when rotating defining a surface of revolution complementary to said surface of revolution of the intermediate portion of said chamber and being closely spaced therefrom, said helical blade operatively urging the slurry downstream; said impeller including a vane with an outer edge and being downstream from said comminutor, the outer edge of said impeller vane having a plurality of projections and when rotating defining a surface of revolution complementary to and closely spaced from a portion of the wall surface of said chamber, wherein the wall of said chamber comprises a liner removably operatively secured to said housing structure, wherein said liner includes a discharge liner segment, having one or more holes for permitting ground up slurry to pass therethrough, said vane urging the slurry towards said outlet port during the rotation of said impeller;

d) said plurality of projections on the wall of said chamber and the complementary shaped rotating blade and impeller vane comprising between them means for cutting, chopping and grinding the solid and semi-solid material of the slurry.

21. A grinding pump according to claim 20, wherein said discharge liner segment includes more than one hole and said holes are of uniform shape and size.

22. A grinding pump, according to claim 20, wherein said discharge liner segment includes more than one hole and at least some of said holes are of different size.

23. A grinding pump, according to claim 20, wherein said liner further comprises a shredding liner segment having a plurality of projections defining a surface complementary to the surface of revolution defined by the rotation of said rotor.

24. A grinding pump, according to claim 23, wherein said liner further comprises a plain liner segment having a relatively smooth surface confronting said rotor.

25. A grinding pump according to claim 24, further comprising a means for securing said liner segments within said chamber for preventing said liner segments from rotating within said chamber.

26. A grinding pump according to claim 25, wherein said means for securing said liner comprises:

a) a rear wall defining the downstream end of said chamber and having a circumferential groove for receiving the downstream end of said discharge liner segment, said shredding liner segment and said plain liner segment;

b) a non-rotatable liner retaining ring disposed between said inlet and said intermediate chamber portion;

c) a pin secured to said retaining ring and extending into said intermediate portion of said chamber; and d) at least one of said liner segments having a hole in the end thereof for receiving said pin, whereby to prevent said liner from rotating.

27. A grinding pump for pumping liquid slurry containing solid and/or semi-solid matter, comprising:

a) a housing structure having a chamber with a longitudinal axis, said chamber having an inlet port, an intermediate portion defined by a wall surface of revolution, said intermediate wall surface having a plurality of projections, an eccentric portion having a wall surface, said eccentric wall surface having a plurality of projections, and an outlet port;

b) a rotatable shaft disposed along said longitudinal axis within said chamber;

c) a rotor mounted on said shaft within said chamber for rotation therewith and comprising a comminutor and an impeller, said comminutor including a helical blade having an outer edge, the outer edge of said helical blade having a plurality of projections, wherein the plurality of projections on the outer edge of said blade are serrated or tooth shaped, and when rotating defining a surface of revolution complementary to and closely spaced from said surface of revolution of the intermediate portion of said chamber, said rotating helical blade operatively urging the slurry downstream; said impeller including a vane with an outer edge and being downstream from said comminutor, the outer edge of said impeller vane having a plurality of projections, wherein the plurality of projections on the outer edge of said vane are serrated or tooth shaped, and when rotating defining a surface of revolution complementary to and closely spaced from a portion of the wall surface of said chamber, said vane urging the slurry towards said outlet port during the rotation of said impeller, d) the plurality of projections on the wall of said chamber and the complementary shaped rotating helical blade and impeller vane together comprising means for cutting, chopping and grinding the solid and semi-solid material of the slurry.

28. A grinding pump according to claim 27, wherein the liner includes a shredding liner segment and the surface of said shredding liner segment is serrated or tooth shaped complementary to said helical blade and vane edges.

29. A grinding pump according to claim 28, wherein said shredding, plain and discharge liner segments each has a hole at both ends so as to permit said liners to be reversible and equally engagable with said pin at either end.

* * * * *